US006744693B2

(12) United States Patent
Brockmann et al.

(10) Patent No.: US 6,744,693 B2
(45) Date of Patent: Jun. 1, 2004

(54) LIGHTING FIXTURE

(75) Inventors: Thomas Brockmann, Copenhagen (DK); Peter I. W. Plesner, Praestoe (DK); Christian Poulsen, Copenhagen (DK)

(73) Assignee: N.V. ADB TTV Technologies SA, Zaventem (BE)

( * ) Notice: Subject to any disclaimer, the term of this patent is extended or adjusted under 35 U.S.C. 154(b) by 0 days.

(21) Appl. No.: 09/845,506

(22) Filed: Apr. 30, 2001

(65) Prior Publication Data

US 2002/0060911 A1 May 23, 2002

Related U.S. Application Data

(60) Provisional application No. 60/201,489, filed on May 3, 2000.

(51) Int. Cl.[7] ..... F21V 17/02

(52) U.S. Cl. ..... 365/321; 362/322; 362/323; 362/269; 362/271; 362/272; 362/277; 362/296; 362/275

(58) Field of Search ..... 353/80, 97, 197, 353/84, 95; 359/233, 234; 362/321, 322, 323, 269, 270, 271, 272, 277, 287, 35, 296, 275

(56) References Cited

U.S. PATENT DOCUMENTS 2,195,166 A * 3/1940 Diggins ..... 359/234
2,439,330 A * 4/1948 Zander ..... 359/234
2,465,578 A * 3/1949 Czarnikow et al. ..... 396/510
3,049,615 A * 8/1962 Sawyer ..... 362/35
4,210,955 A 7/1980 Labrum
4,890,208 A 12/1989 Izenour
5,345,371 A 9/1994 Cunningham et al.

FOREIGN PATENT DOCUMENTS

| | | |
|---|---|---|
| EP | 0563483 | 11/1992 |
| EP | 0684424 | 5/1995 |
| WO | WO99/67569 | 12/1999 |

* cited by examiner

*Primary Examiner*—Sandra O'Shea
*Assistant Examiner*—Sharon Payne
(74) *Attorney, Agent, or Firm*—Klein, O'Neill & Singh

(57) ABSTRACT

A lighting fixture projects a light beam for spot lighting in theater stages, cinema and television studios and the like. The fixture includes a light source at one end of a housing having a light beam exit aperture at the opposite end thereof, the light source and aperture being arranged generally concentric with a longitudinal or optical axis of the lighting fixture. One or more beam-shaping blades, and preferably also other light beam influencing elements, such as one or more lenses, an iris, and/or a pattern or gobo, are arranged along the path of the light beam along the longitudinal axis through the housing from the light source to the aperture. The position of the beam-shaping blade or blades, and preferably of all the light beam influencing elements, is adjustable relative to the longitudinal axis. The fixture produces a well-defined light beam or light cone with a geometry, angle of conicity and focal point that may be altered manually or by remote control.

8 Claims, 12 Drawing Sheets

LIGHTING FIXTURE

CROSS-REFERENCE TO RELATED APPLICATION

This application claims the benefit, under 35 U.S.C. §119(e), of U.S. Provisional Application No. 60/201,489; filed May 3, 2000 now abandoned.

FEDERALLY-SPONSORED RESEARCH OR DEVELOPMENT

Not Applicable

BACKGROUND OF THE INVENTION

The present invention relates to a lighting fixture for projecting a beam of light and for use for spot lighting in connection with theater stages, cinema and television studios and the like, the fixture comprising:

a light source arranged at one end of a housing having a light beam exit aperture at the opposite end thereof, the light source and aperture being arranged generally concentric with a longitudinal or optical axis of the lighting fixture, light beam influencing means at least comprising one or more, preferably four, beam-shaping blades and preferably also comprising other light influencing means such as one or more lenses and/or an iris and/or a pattern or gobo, for influencing a light beam emitted by the light source and being arranged along the path of the light beam along said longitudinal axis through the housing from the light source to the aperture, and adjustment means for adjusting the position of at least said one or more beam-shaping blades and preferably of all said influencing means relative to said longitudinal axis.

The purpose of a lighting fixture as defined above is to produce a well-defined light beam or light cone with a geometry, angle of conicity and focal point that may be altered manually or by remote control.

A lighting fixture will normally comprise a light source, a reflector, a beam-shaping gate with beam-shaping blades, a pattern or gobo, an iris, a focusing lens, a zoom lens and a color filter as well as a suspension structure allowing the lighting fixture to be pivoted vertically and horizontally.

The visible part of the light emitted by the light source is collected by the reflector and is sent towards the iris, the gobo and the beam-shaping gate as a parallel light beam. The infrared part of the radiation from the light source passes through the dichroic coating of the reflector and impinges on the inner surface of the housing surrounding the light source, the heat being transported to the outer surface of the housing having cooling ribs for emitting the heat to the surrounding atmosphere.

It is often necessary to be able to determine the geometry of the light beam, and this is achieved by means of the zoom lens varying the angle of conicity of the light cone and by shaping or cutting off the periphery of the light beam by means of the beam-shaping gate with beam-shaping blades so as to obtain geometrical figures such as squares, triangles, trapezoids etc. The lenses project the light out through the aperture of the housing opposite the light source and through the color filter at the front end of the lighting fixture. It is important that the different elements influencing the shape and other characteristics of the light beam function as precisely as possible even when being influenced by the heat radiated from the light source and not removed by means of the dichroic reflector. This entails that the location and the configuration of the adjustment means for the beam-shaping blades, the gobo and iris are such that any bending caused by the heat influence from the light beam be kept at a minimum.

Lighting fixtures of this type are often arranged in places where it is difficult to access them manually and it is therefore of great importance that the adjustment means for adjusting the above-mentioned beam influencing means be as easily accessed and as flexible as possible when manual operation of the adjustment means is required.

U.S. Pat. No. 5,345,371 discloses a lighting fixture of the type in reference where the four beam-shaping blades or shutters are slidingly insertable in slots from outside, the shutters being radially adjustable by gripping a holder for each shutter and sliding the shutter in or relative to the optical axis. The shutters may also be tilted manually to a certain extent. However, a further tilting possibility is achieved by allowing the portion of the fixture containing the shutters to be rotated as a unit around the axis. This is a complicated solution and needs manual access to all holders of the shutters as well as manipulation of the rotation means for rotating part of the fixture. Motorization for remote control of this design will be very complicated and costly.

U.S. Pat. No. 4,890,208 discloses a lighting fixture of the type in reference where four shutters are arranged for motorized displacement radially toward the optical axis and motorized tilting by means of rack and pinion mechanisms. This solution is complicated and has only limited tilting capability, i.e. displacement capability circumferentially around the axis. Furthermore this solution is not well suited for manual operation.

SUMMARY OF THE INVENTION

It is an object of the invention to provide a lighting fixture of the type indicated, wherein access for manual operation is convenient and not dependent on the orientation of the lighting fixture, wherein motorization for remote control may be established in a simple and reliable manner and wherein the range of displacement circumferentially around the optical axis is as great as possible.

According to the invention this object is achieved by at least the adjustment means corresponding to said one or more beam-shaping blades and preferably all the adjustment means are arranged for rotation around said longitudinal axis and are connected to a respective influencing means such that rotation of the adjustment means around said longitudinal axis adjusts the position of the respective influencing means relative to said longitudinal axis.

Hereby the adjustment means may be accessed from practically any angle, and no limit to the adjustment possibilities in circumferential direction is inherent.

In the currently preferred embodiment the adjustment means comprise an annular body arranged with the axis thereof substantially coinciding with said longitudinal axis. This is a particularly simple and effective embodiment.

In the currently preferred embodiment of the invention the annular body comprises an outer rim configured for being engaged for applying rotational force thereto, the surface of said outer rim being provided with friction enhancing means such as roughening means, rubber surfacing, projections or teeth. Hereby manual and remote operation of the adjustment means is particularly simple and efficient.

Advantageously, the fixture further comprises one or more electrical motors connected to a respective drive wheel engaging said outer rim of a respective annular body for applying a rotational force thereto, and preferably the drive wheel is a gear having teeth, and the respective outer rim engaged by a respective gear is provided with teeth for meshing with the teeth of said gear when said gear rotates.

For use in remote control of the lighting fixture with pre-determined positions of the light influencing means, it is advantageous that the annular body be provided with a position indicating means for indicating the angular position of the annular body relative to said longitudinal axis. Hereby a reference point for the remote control operation is available, thereby eliminating errors and inaccuracies.

Advantageously, the position indicating means comprises an element that may be remotely sensed such as a magnet or a gap, and the fixture further comprises remote sensing means for sensing the angular position of said element relative to said longitudinal axis.

So as to obtain the greatest flexibility of adjustment and the greatest range of adjustment, the adjustment means for each of the one or more beam-shaping blades comprises radial adjustment means for adjusting the position of the blade radially relative to said axis, and circumferential adjustment means for adjusting the position of said blade circumferentially around said axis.

A particularly simple and efficient as well as accurate embodiment of the light fixture according to the invention is provided by the adjustment means for each of the one or more beam-shaping blades comprising two adjacent co-centrical annular bodies or rings each connected to one point of the blade such that relative rotation of the two rings alters the radial position of the blade.

In the currently preferred embodiment, the rings comprise guiding tracks recessed into the lateral surface of each ring facing the other ring, and each blade comprises a body extending generally transversely to said axis and two arms extending generally parallel to said axis, the arms each being provided with sliding connecting means for connecting the respective arm to each of the rings and being adapted for being slidingly received in a guiding track in each of said rings.

BRIEF DESCRIPTION OF THE DRAWINGS

In the following description, preferred embodiments of a lighting fixture according to the invention will be described in detail, solely by way of example, with reference to the accompanying drawings, where.

DETAILED DESCRIPTION OF THE INVENTION

Figure 1:
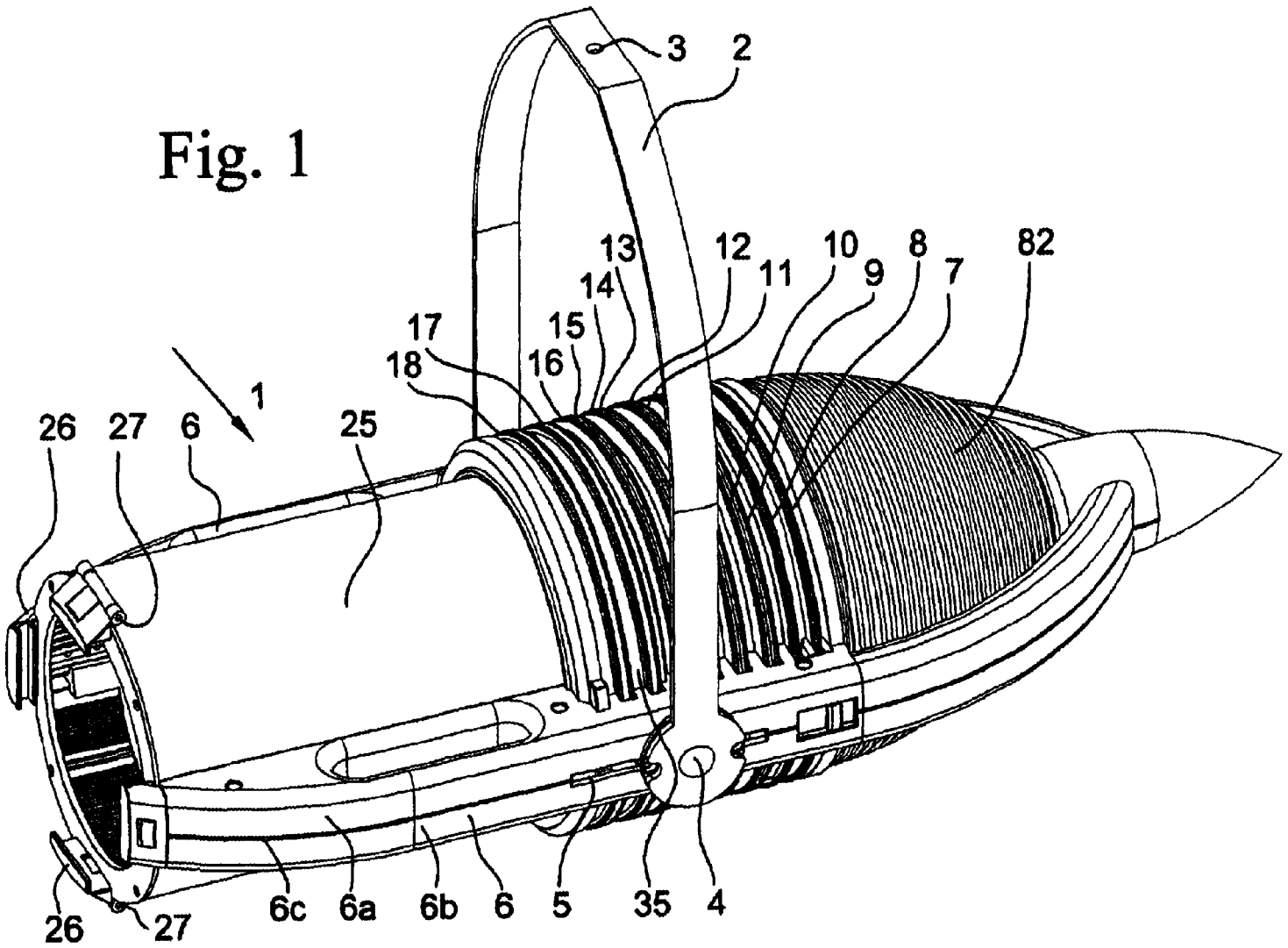
FIG. 1 is an isometric elevational view of a lighting fixture according to the invention for manual operation.
Figure 2:
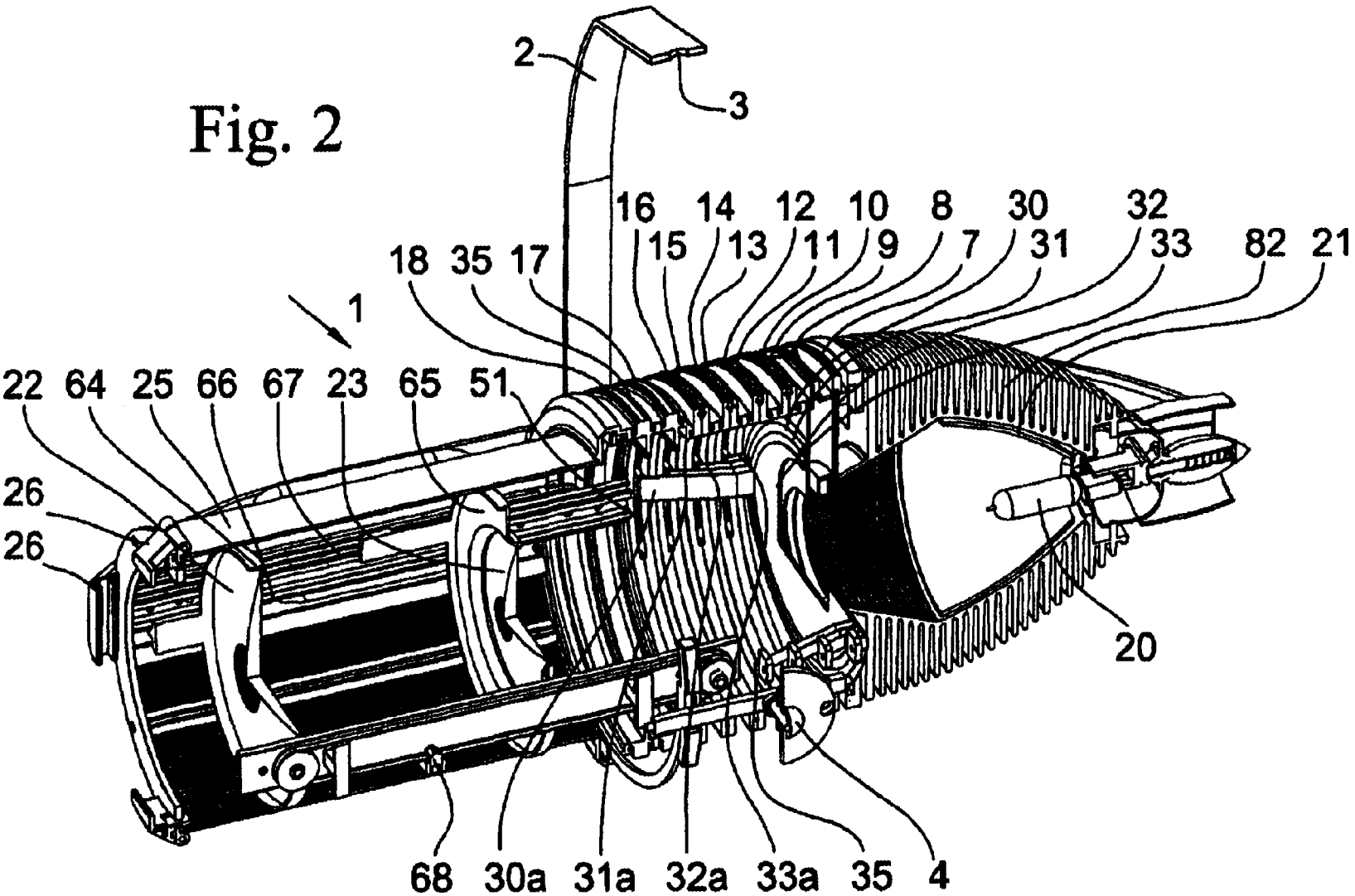
FIG. 2 is a partially cut-away view of the lighting fixture in FIG. 1 illustrating the internal configuration of the lighting fixture.
Figure 3:
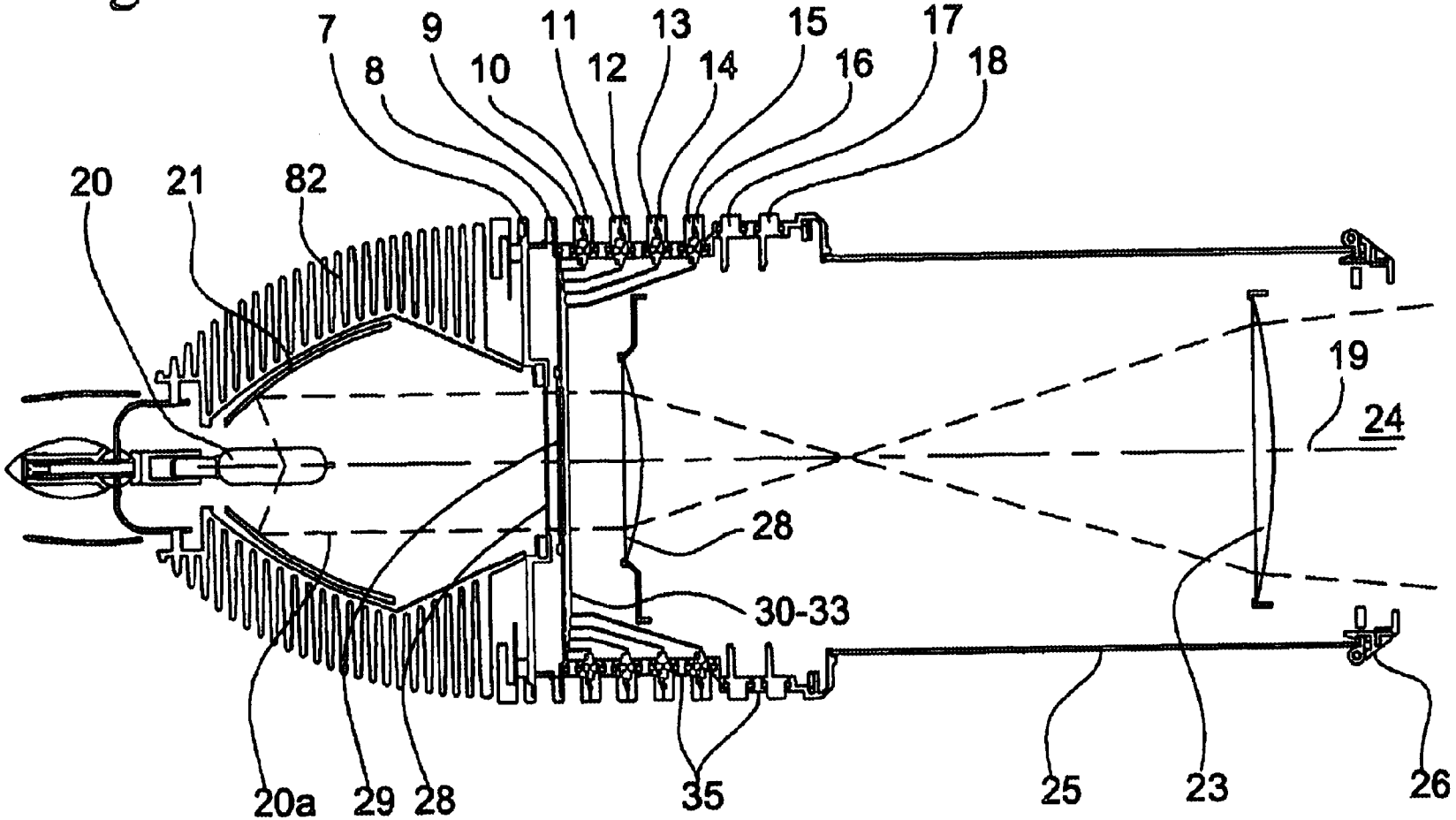
FIG. 3 is a schematic cross-sectional view of the lighting fixture of FIGS. 1 and 2, the cross-section being taken along a vertical plane containing the longitudinal or optical axis of the lighting fixture.

Referring now to FIGS. 1-5, a lighting fixture 1 according to the invention is suspended in a suspension fitting 2 having an aperture 3 for fixing the fitting 2 pivotably to a support structure (not shown) in a theater, a television studio or the like. The fitting 2 is pivotably attached to the body of the lighting fixture 1 at 4, the attachment point being adjustable by sliding the pivot attachment point 4 in a slit 5 in a frame 6 so as to compensate for change of balance because of insertion or removal of different elements in the lighting fixture 1.

The lighting fixture 1 may thus be manually pivoted around two mutually substantially orthogonal axes allowing the direction of a light beam emitted by the fixture to be any desired direction.

If it is desired to be able to remotely control the direction of the beam, the pivoting action may be achieved by means of remotely controlled electrical motors in many different ways that will be obvious to those skilled in the art.

The frame 6 is generally U-shaped having two arms supporting the body of the lighting fixture 1 between said arms. A series of toothed rims 7-18 are arranged for rotation around a longitudinal or optical axis 19 (see FIG. 3). The teeth of the toothed rims are configured such that the teeth of a pinion of a drive unit may engage and mesh therewith if the light beam influencing facilities of the lighting fixture operated by rotation of the bodies 7-18 are to be motorized for remote control.

In the manually operated embodiment shown in FIGS. 1-4, the teeth of the toothed rims serve as a roughening element of the surface of the rim of each of the annular bodies 7-18 such that good frictional engagement between the fingers of a hand and the toothed rims or annular bodies 7-18 may be achieved for rotating the annular bodies 7-18 manually.

Such roughening of the rim surface may be achieved in many other ways such as scoring of the surface or coating with rubber or provision of small projections etc.

In such case and if motorization of the rotation of the bodies 7-18 is desired, then a frictional surface engagement of for instance the surface of a rubber coated drive wheel driven by an electrical motor with the roughened rim surface may be provided for instead of the meshing of the teeth of a pinion with teeth of the rim of the annular body.

A light source or lamp 20 emits a light beam composed of individual light beams such as illustrated at 20*a*, the visual portion thereof being reflected by a dichroic reflector 21 through a focusing lens 22 and a zoom lens 23 and out of the lighting fixture through an aperture 24 in the housing 25 of the fixture 1, the light beam 20*a* traveling through a color filter (not shown) arranged in four color filter holders 26 that may be pivoted around pivots 27 so as to allow a color filter to be inserted and removed in the holders 26 in any of four directions determined by the four holders 26. Hereby the color filter may be inserted and removed from the best angle for manual access for a given orientation of the housing 25. The entire light beam projected by the lighting fixture is of course composed of a plurality of light beams analogous to individual light beam 20*a*.

The infra red portion of the light beam 20*a* is transmitted through the dichroic reflector 21 to cooling ribs 82 in a manner well known in the art so as to reduce the heat distortion of light beam influencing elements, as described below, that are arranged along the path of the light beam from the light source 20 to the exit aperture 24.

These light beam influencing elements comprise an iris 28 connected to the annular body 7, a pattern or gobo 29 connected to the annular body 8, four beam-shaping blades 30, 31, 32 and 33 connected to the pairs of annular bodies, 9-10, 11-12, 13-14 and 15-16, respectively, the focusing lens 22 connected to the annular body 17, and the zoom lens 23 connected to the annular body 18.

The annular bodies or rings 7-18 are connected in different manners to the respective light beam influencing elements 22, 23 and 28-33 so that the position of these elements may be altered relative to the axis 19, and thus the light beam, by rotating the rings around said axis. The individual connections between the individual rings and the respective elements will be described more in detail below.

The feature of being able to alter the position of the light beam influencing elements, and particularly of the light beam shaping blades 30-33, by means of rotating the corresponding rings allows the position alteration to be carried out manually from a convenient angle of approach for a given orientation of the housing 25. As the rim surface of each of the rings 7-18 may be engaged manually at most of the extent of the circumference thereof, the manual adjustment of the position of a respective light beam influencing element may be performed from the most convenient angle of approach to the housing 25. Furthermore, the manual adjustment may be carried out with one hand which is important, as the fixture is often located such that access with both hands is difficult and perhaps impossible.

Hereby the lighting fixture according to the invention does not have the disadvantages of known lighting fixtures where the adjustment means for adjusting the position of a light beam shaping blade may be very inconveniently located relative to the position of the person operating the lighting fixture so that the person for instance has to reach around the lighting fixture housing to access the adjustment means thereby risking being burned on the hot housing surface and rendering rapid and precise position adjustment difficult and perhaps impossible.

This advantage can also be obtained by rotational means other than rings with a rim surface for being engaged manually or mechanically. Elements having a plurality of radially extending spokes spaced circumferentially for being engaged at the ends thereof by fingers of a hand or a motorized driving means may also be used. A circumferentially disposed endless belt arranged for substantially circular movement around the longitudinal axis may also be utilized instead of the illustrated rings. All means allowing access along a major part of the circumference of the housing and rotational frictional engagement by fingers or a motorized drive unit may be used to allow such convenient access to the adjustment means for altering the position of the beam influencing elements.

The feature of altering the position of the light influencing elements by rotational means also entails simple and reliable establishment of a certain adjustment setting of a respective influencing means such that pre-programmed settings may be set up for certain lighting requirements knowing that it will be simple, quick and reliable to achieve such settings either manually or remotely under difficult conditions, for instance during the course of a theater show where adjustments in the dark are necessary.

A further advantage is obtained by the shown structure according to the invention in that the construction is such that no light is emitted from the interior of the fixture except through the aperture 24, and all adjustments of the light beam influencing elements may be carried out without creating a light emission slit or aperture. Hereby, the disadvantage of all known lighting fixtures that light "leaks" therefrom is eliminated which is of great value, particularly for theater use.

Referring again to FIGS. 1-5, the frame 6 is constituted by two identical halves 6*a* and 6*b* abutting each other at 6*c*. The rings or annular bodies 7-18 are rotatably and slidingly supported in annular grooves 34 in annular support rings 35 by means of annular projections or ridges 36 slidingly received in the annular grooves 34. The support rings 35 are each constituted by half a ring fixedly attached to or made in one piece with one half of the frame 6, for instance 6*a* (see FIG. 1). In other words each of the frame halves 6*a* and 6*b* is fixedly attached to or integral with a series of half rings 35 as shown in FIG. 5, where the bottom half 6*b* of the frame 6 is shown with the corresponding half rings 35.

When assembling the lighting fixture 1, the adjustment rings 7-18 with corresponding beam influencing elements 22, 23 and 28-33 are arranged in the bottom half 6*b* of the frame with corresponding half rings 35 such that the ridge 36 of each adjustment ring is received in the corresponding groove 34 of the respective half ring 35 of the bottom frame half 6*b*. Thereafter the top half 6*a* of the frame 6 with corresponding half rings 35 is placed abutting the bottom half 6*b* at 6*c* such that the ridge 36 of each adjustment ring is received in the corresponding groove 34 of the respective half ring 35 of the top frame half 6*a*. The adjustment rings 7-18 will thus be slidingly and rotationally supported along the entire circumference thereof by the corresponding rings 35.

Each of the adjustment rings or annular bodies 7-18 may then be rotated manually or by means of suitable mechanical means by applying a tangential force to the rim of the respective adjustment ring whereby the ridge 36 thereof slides in the respective annular groove 34 of the respective support ring 35. The material of the ridges 36 and the grooves 34 are chosen such that frictional sliding resistance is kept at a minimum. The support rings 35 may be made of cast aluminum, and the adjustment rings may be made of glass-fiber reinforced plastic. The ridges 36 are made of a low frictional material such as PTFE (marketed, for example, under the trademark "TEFLON"), a ring of said material being embedded in the lateral surface of the corresponding adjustment ring. Hereby the frictional sliding resistance between the low friction material and the cast aluminum will be low, and the adjustment rings may consequently be rotated by applying a relatively small tangential force to the rim thereof.

Each of the adjustment ring pairs 9/10, 11/12, 13/14 and 15/16 carries a respective light beam shaping blade 33, 32, 31 and 30, respectively, by means of pairs of arms 33*a,b*, 32*a,b*, 31*a,b* and 30*a,b*, respectively, held by the adjustment ring pairs in a manner described more in detail below. So that the two rings of each ring pair can rotate relative to one another, a low friction material ring 37 is arranged between each pair of adjustment rings as illustrated in FIGS. 4 and 6.

Referring now to FIGS. 4 and 6-9, the arrangement of the four light beam shaping blades 30-33 will now be explained more in detail.

Figure 4:
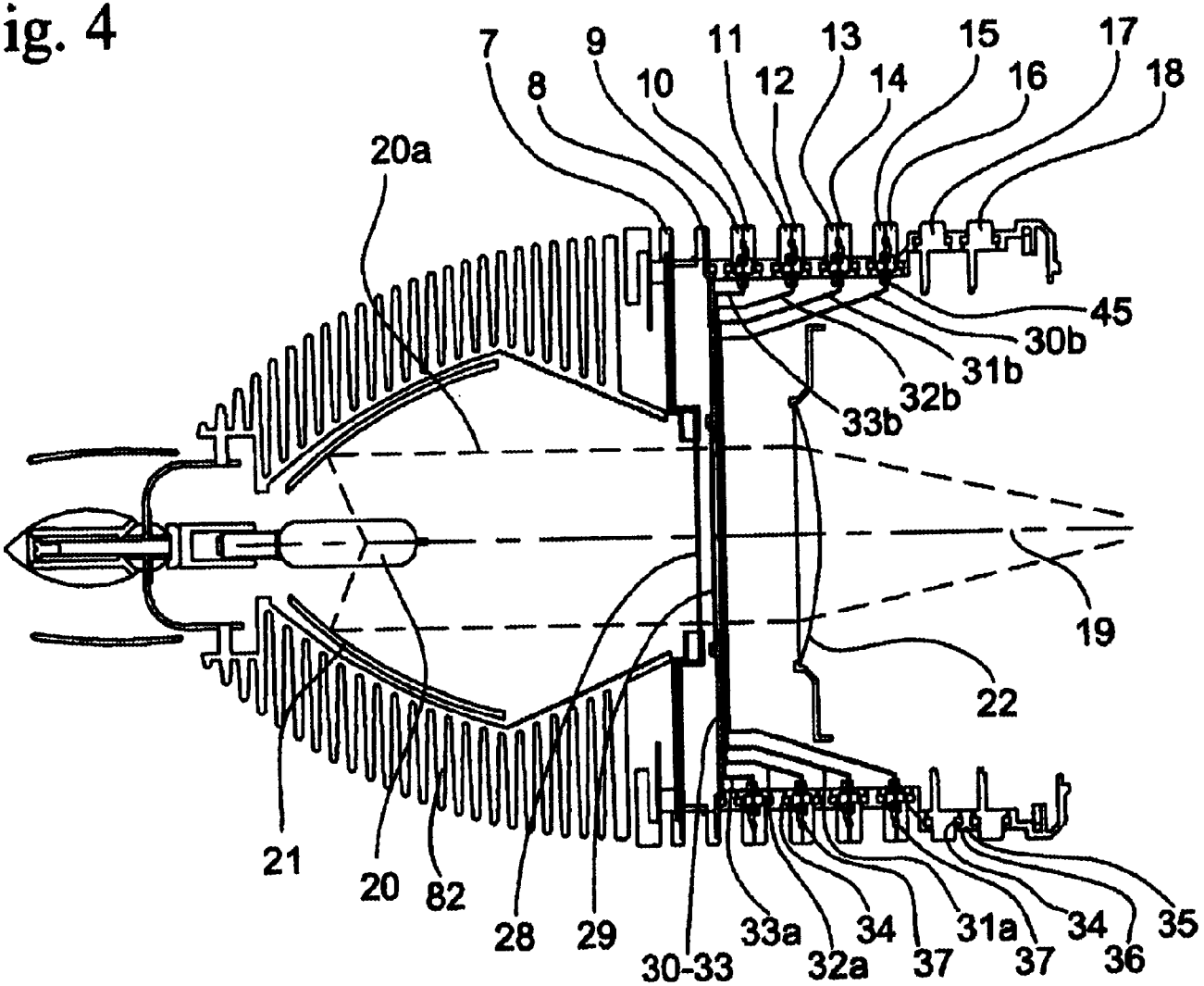
FIG. 4 is an enlarged scale view of the left-hand part of FIG. 3.
Figure 5:
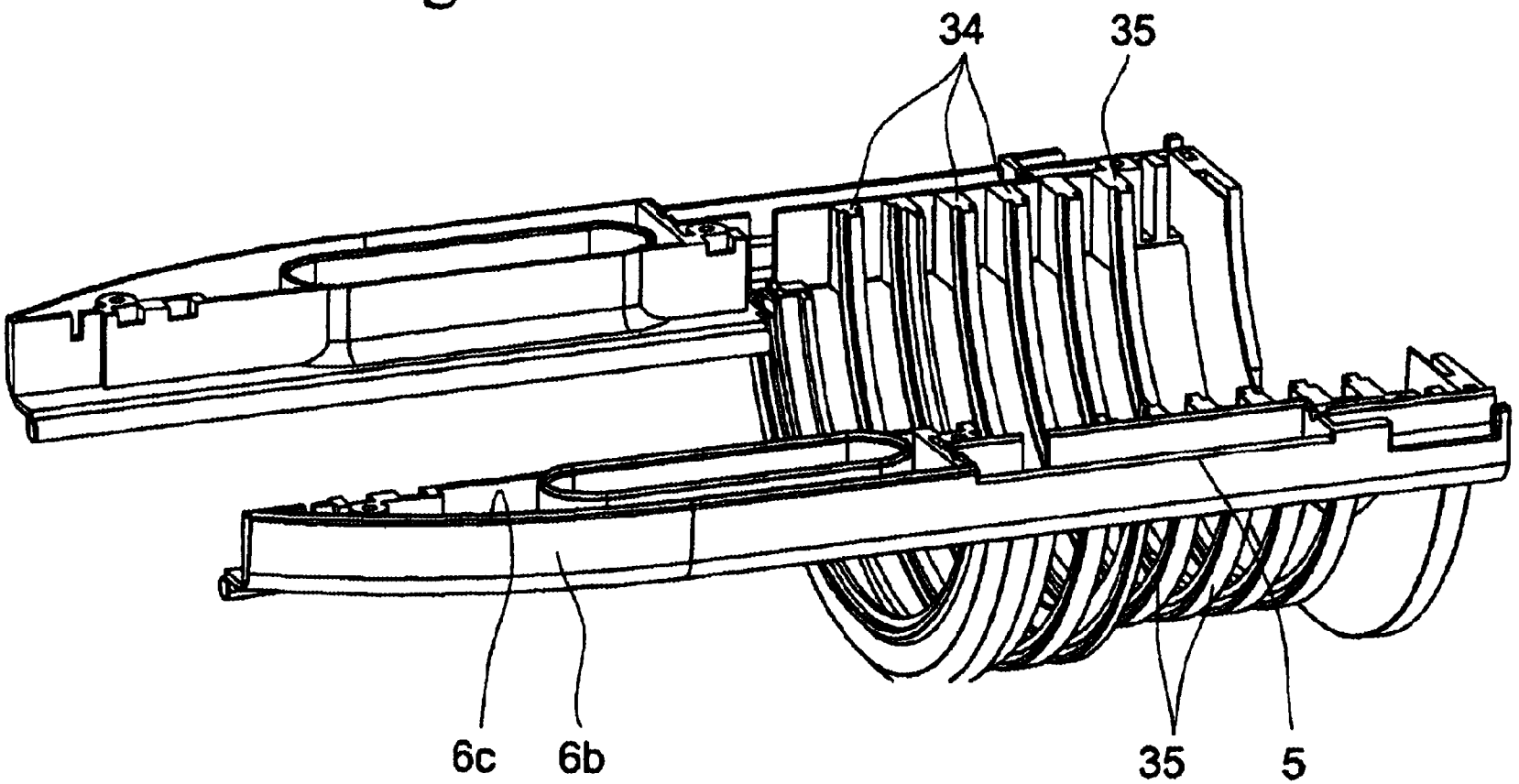
FIG. 5 is an isometric elevational view of the bottom half of the frame of the lighting fixture of FIGS. 1 and 2.
Figure 6:
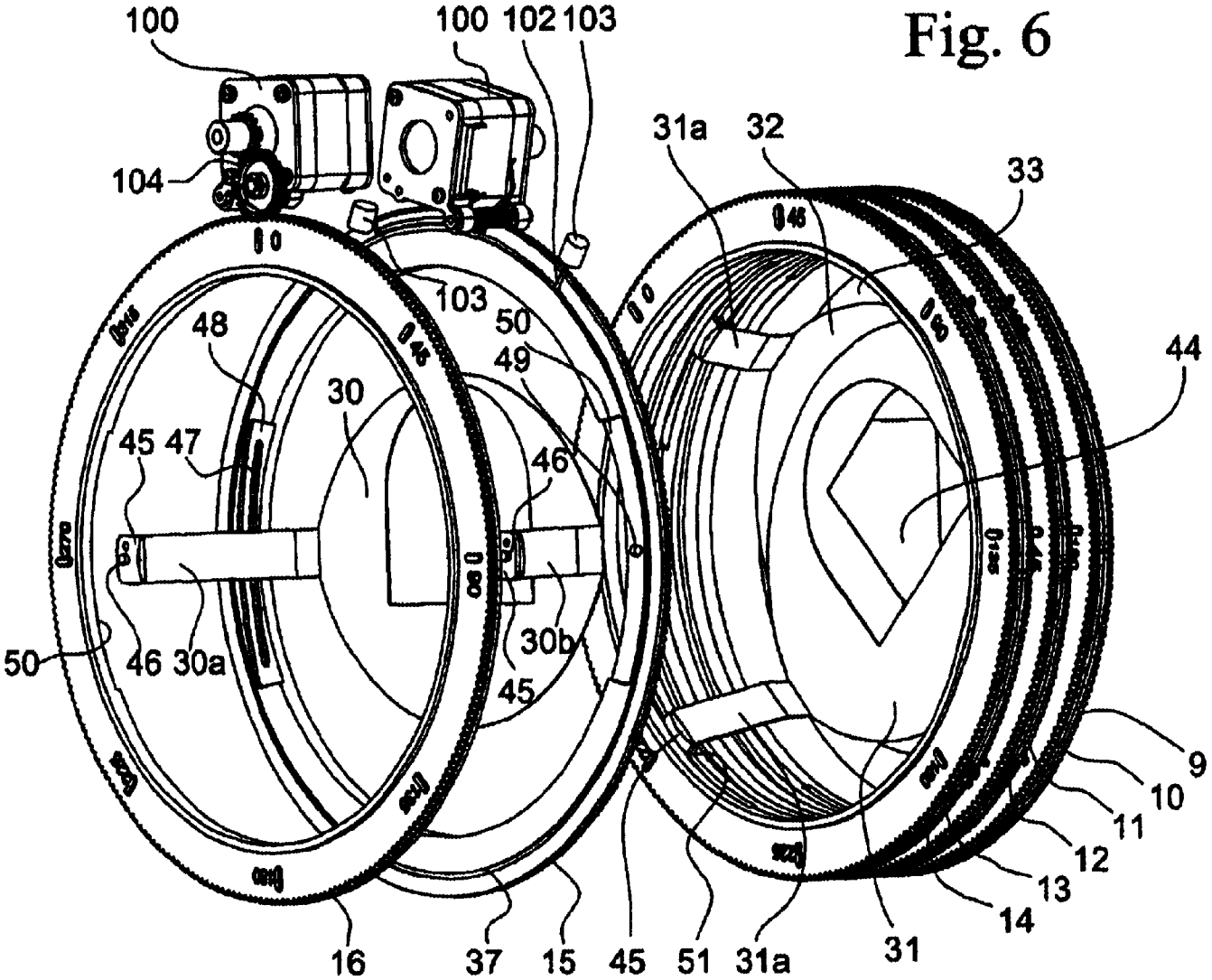
FIG. 6 is an exploded view of the beam-shaping blades and adjustment rings of the fixture in FIGS. 1 and 2.
Figure 7:
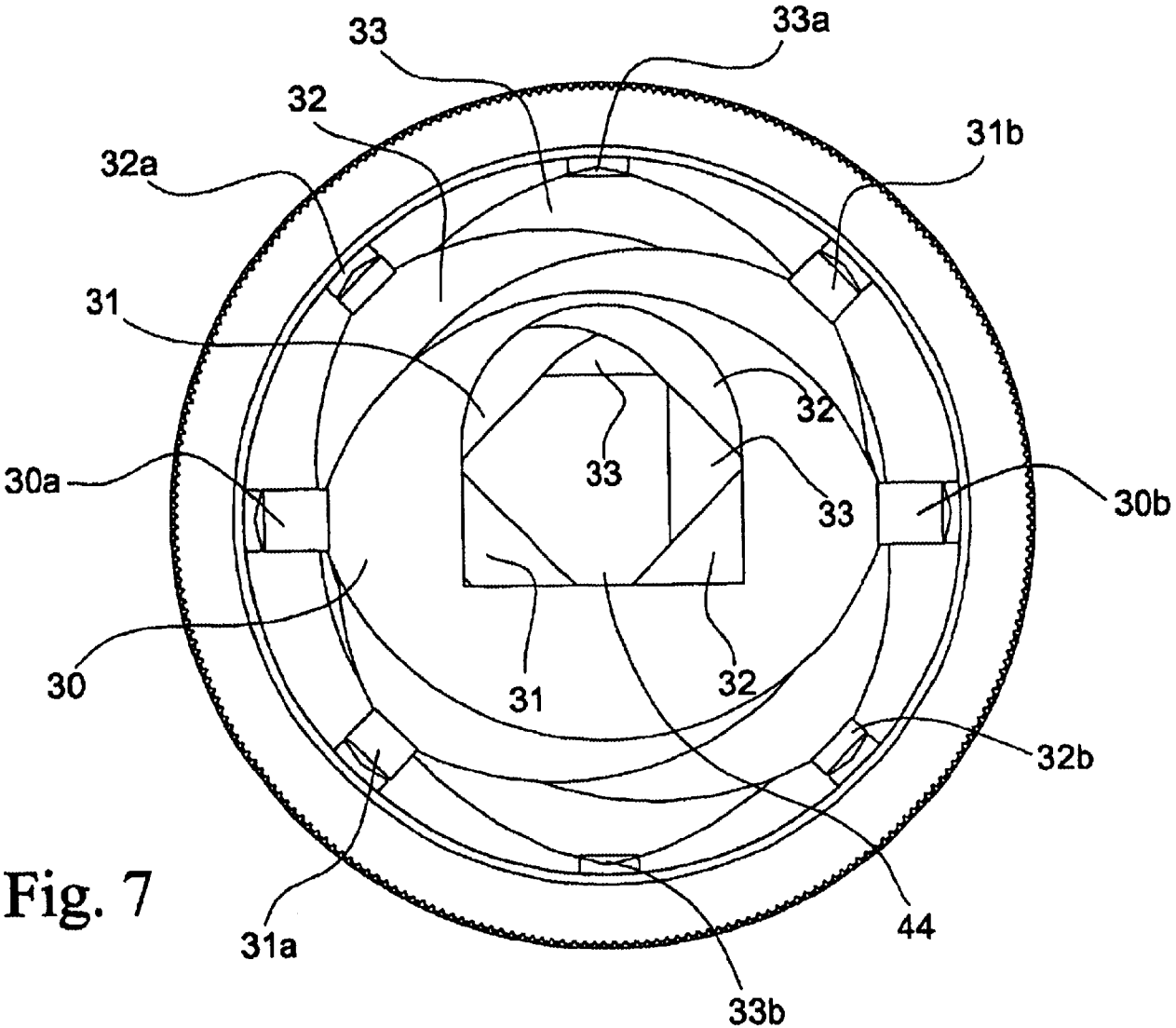
FIG. 7 is an axial end view of the blades and rings shown in FIG. 6 in nested assembled condition.

The blades 30-33 are nested as illustrated in FIGS. 4, 6 and 7, each blade 30-33 being carried by a pair of opposed arms, 30*a*-33*a* and 30*b*-33*b*, respectively. It is important that the blades 30-33 are located as axially close to each other as possible so as to achieve a sharp cut-off boundary of the light beam all around the circumference thereof which only can be achieved if the blades are arranged such that there is no substantial distance between them in the axial direction of the housing. This is particularly well illustrated in FIGS. 3 and 4 where it is evident that the spacing of the blades in the direction of the axis 19 is slight.

The arrangement shown also has the advantage that the axial distance between the beam-shaping blades 30-33 and the iris 28 as well as the gobo or pattern 29 is small so that a good sharpness or quality of the influence of the blades, the iris and the gobo on the light beam may be obtained simultaneously because of the small axial distance covered by all said elements.

Figure 8:
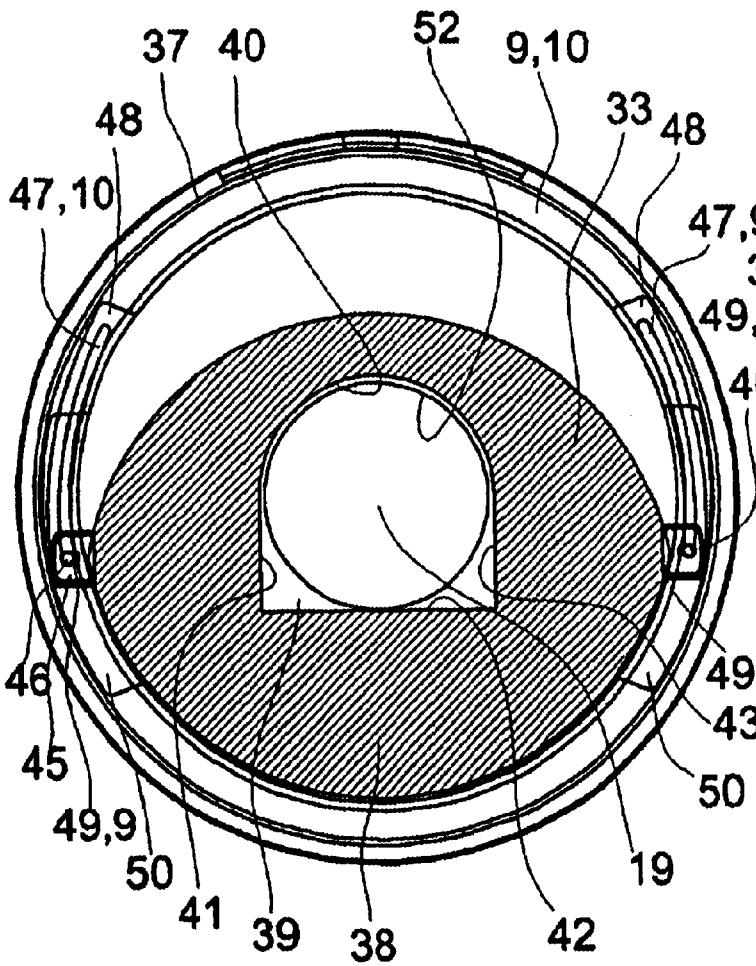

The blades 30-33 are shaped as shown in FIGS. 6-8 having a generally elliptical planar body 38 with an aperture 39 having a periphery comprising a curved portion 40 and linear portions 41, 42 and 43, said periphery serving as the beam cut-off edge of the blade body 38. This is illustrated in FIG. 7 where the peripheries of the apertures 39 of the four bodies 38 of the blades 30-33 define the periphery of the beam shaping aperture 44. A multitude of different shapes of the aperture 44 may be achieved by a combination of a rotation of the different blades 30-33 around the axis 19 with a displacement of said blades 30-33 radially relative to said axis 19.

Figure 9:
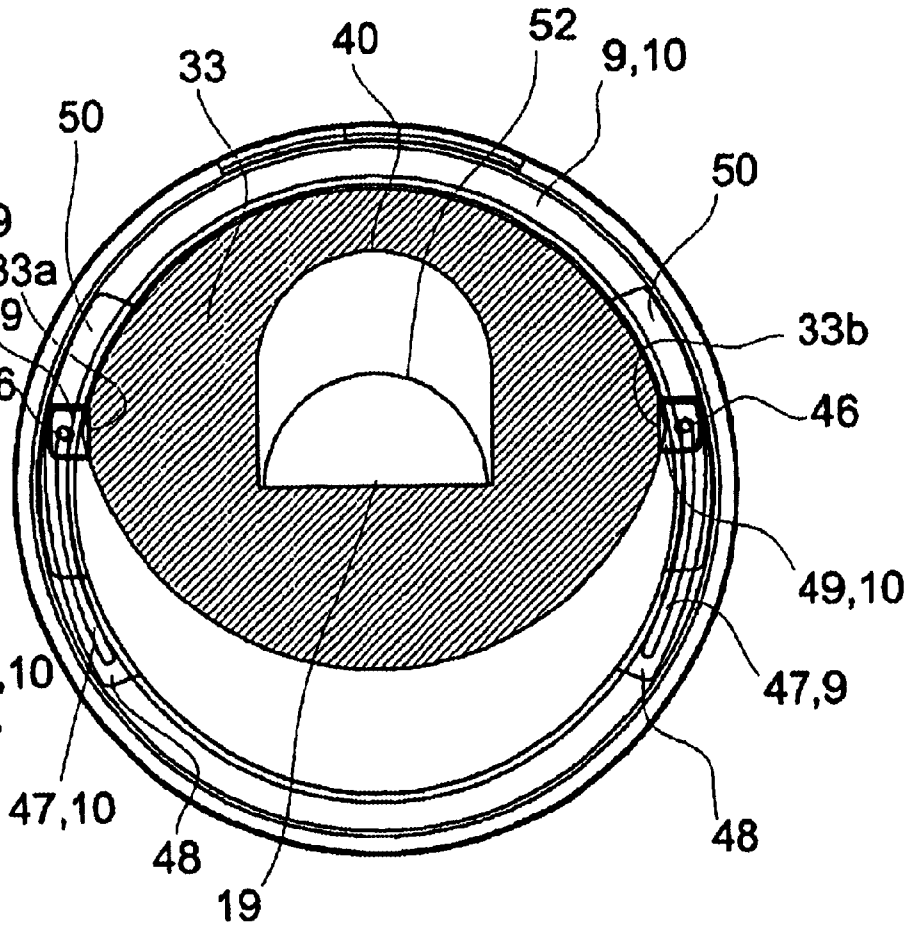
FIGS. 8 and 9 are schematic axial end views corresponding to FIG. 7 illustrating the adjustment of the beam-shaping blades of FIGS. 6-7.

The radial displacement of the individual blades 30-33 is illustrated in FIGS. 8-9 where the periphery portion 42 of blade 33 is shown in FIG. 8 at the maximum radial distance from the axis 19 and in FIG. 9 at the minimum radial distance from said axis 19. The rotational displacement is achieved by rotating the ring pair 9/10 carrying the blade 33 around the axis 19. Combinations of the radial and the rotational displacement of each blade allow the creation of a great variety of peripheral shapes for the aperture 44.

The elliptical shape of the 39 has been chosen to give a relatively stiff blade as well as a continuous and smooth outer perimeter of the body. Hereby the bodies of the blades will not interfere with one another when they are displaced relative to one another even though the axial spacing of the bodies is small. So as to avoid such mutual interference between the bodies as well as between the pairs of arms 30*a,b*-33*a,b* it is advantageous that the radial displacement of the bodies take place in such a manner that practically no flexing of the arms takes place during such displacement, i.e. that the distance between the ends of the arms of each pair is constant during such radial displacement and that no torsional forces are exerted on the arms during such radial displacement.

In the currently preferred embodiment of the invention shown in FIGS. 1-9, this is achieved as follows:

Each arm is provided with an angled end portion 45 having a guiding pin 46 extending therethrough and projecting from both opposed surfaces of the angled portion 45. The plane of each end portion 45 is substantially parallel to the plane of the body 38 of the respective blade.

Figure 10:
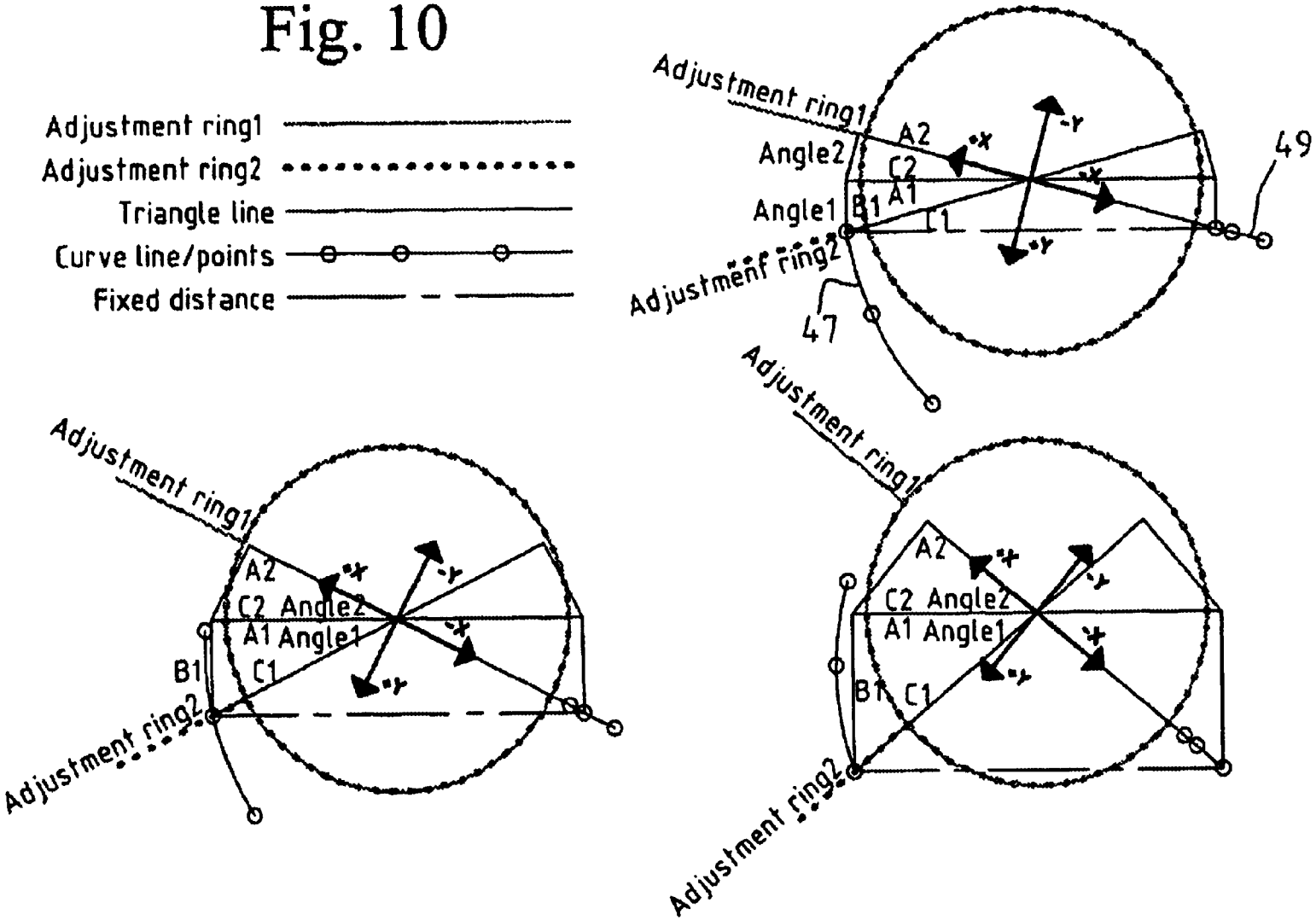
FIG. 10 is an illustration of the constructive principles of the guiding tracks in the adjustment rings for the beam-shaping blades.

The rings of each pair of rings, for instance 15 and 16 in FIG. 6 or 9 and 10 in FIGS. 8-9, are identical, and one lateral surface of each ring is provided with a recessed circumferentially extending track 47 in the bottom of an annular circumferentially extending recess 48 and an elongate radially extending track 49 in the bottom of an annular circumferentially extending recess 50 identical to the recess 48 and arranged diametrically opposite the recess 48.

The two rings 15, 16 in FIG. 6 and the two rings 9, 10 in FIGS. 8 and 9 are arranged abutting each other with the lateral surfaces thereof provided with the recesses 48 and 50 facing one another such that the recess 48 of the ring 15 (ring 9) faces and overlies the recess 50 of the ring 16 (ring 10), and the recess 50 of the ring 15 (ring 9) faces and overlies the recess 48 of the ring 16 (ring 10). Hereby annular channels 51 for receiving the angled end portions 45 of the arms are formed when the rings of a pair 9/10, 11/12, 13/14 or 15/16 are arranged abutting each other.

One of the two projecting ends of each guiding pin 46 of each end portion 45 is inserted in the circumferential track 47 of one ring of a pair of rings while the other projecting end is inserted in the radial track 49 of the other ring of said pair of rings.

The geometries of the tracks 47 and 49 are such that when one ring of a pair of rings is rotated relative to the other ring of the pair, then the respective body 38 of the blade carried by the pair of rings in question is displaced radially such that the distance between the pins 46 of the two arms of the respective blade remains constant and the arms are not subjected to any torsional stresses.

In FIGS. 8 and 9 the ring pair 9/10 is shown with the ring 9 abutting and overlying the ring 10. In the illustration both rings are shown in full lines for the sake of clarity and to illustrate the relative positions of the tracks 47 and 49 of both rings.

In FIG. 8 the ring 10 has been turned 10 degrees clockwise such that the track 47 thereof shown at left in FIG. 8 is turned 10 degrees clockwise, while the ring 9 has been turned 10 degrees counterclockwise so that the track 47 thereof shown at right in FIG. 8 is turned 10 degrees counterclockwise. Consequently the track 49 of the ring 10 shown at right in FIG. 8 is turned 10 degrees clockwise while the track 49 of the ring 9 shown at left in FIG. 8 is turned 10 degrees counterclockwise. The angles clockwise and counterclockwise are given relative to an initial position where the body 38 is at the halfway position between FIG. 8 and FIG. 9. The maximum periphery of the light beam is shown by the circle 52.

In FIG. 9 the ring 10 has been turned 10 degrees counterclockwise such that the track 47 thereof shown at left in FIG. 9 is turned 10 degrees counterclockwise, while the ring 9 has been turned 10 degrees clockwise so that the track 47 thereof shown at right in FIG. 9 is turned 10 degrees clockwise. Consequently the track 49 of the ring 10 shown at right in FIG. 9 is turned 10 degrees counterclockwise, while the track 49 of the ring 9 shown at left in FIG. 9 is turned 10 degrees clockwise.

All intermediate positions between the two end positions shown in FIGS. 8 and 9 are achieved by rotating the rings 9 and 10 relative to one another the corresponding amount of degrees between zero and twenty.

A multitude of different beam periphery shapes may be achieved by displacing the blades 30-33 radially by rotating the two rings of the corresponding ring pair relative to one another and by displacing the blades circumferentially by rotating the two rings of a ring pair together.

In FIG. 7 one of infinitely many combinations of radial and circumferential positions of the four blades 30-33 is shown, whereby a beam 44 with the shown eight sided polygonal peripheral shape is achieved.

So as to achieve a distance between the two pins 46 at the ends of the two arms of each of the blades 30-33 that is the same for all radial displacements of the body 38 thereof, and so as to provide that no torsion of the arms takes place such that the body 38 is not subjected to any distorting forces, the shapes of the tracks 47 and 49 are configured accordingly as described in the following, with reference to FIG. 10 which illustrates the construction and calculation of the said shapes of the tracks 47 and 49.

In FIG. 10 three pairs of mutually corresponding points on the curves 47 and 49 are constructed, the angles being exaggerated for the sake of clarity.

The construction of the curves is carried out according to the following:

A1 is constant and equal to half the distance between the two pins 48 of a blade.

C2=A1

Angle1=Angle2

Angle1+Angle2=Angle3

Both triangles are right-angled triangles

Angle 1 is the angle at which ring 1 is set, and Angle 2 is the angle at which ring 2 is set By rotating ring 1 relative to ring 2, Angle 3 is obtained. A center line is constructed from the center of the rings and horizontally to the left such that Angle 1=Angle 2.

Angle 1 and Angle 2 are used to construct two triangles.

A line is drawn along the center line, the line having a length equal to half the length between the two pins 46 of a blade.

This line forms the hypotenuse C2 as well as the triangle side A1 so that the other triangle side B1 can be constructed by drawing a line from the right angle downwards and C1 away from the center until the two lines intersect at a point. This point is on the curve to be constucted for configuring track 47.

$$B1=\mathrm{SIN}(\text{Angle } 1)\times A1 \qquad \text{Equation 1.1}$$

$$C1=A1/\mathrm{COS}(\text{Angle } 1) \qquad \text{Equation 1.2}$$

C1 is now a radius which together with Angle 3 may used to construct the track by means of the equations 1.3:

$$Xtrack47=\mathrm{COS}(\text{Angle } 3)\times C1$$

$$Ytrack47=\mathrm{SIN}(\text{Angle } 3)\times C1$$

Or the equation 1.2 may be inserted in the equation 1.3:

$$Xtrack47=\mathrm{COS}(\text{Angle } 3)\times(A1/\mathrm{COS}(\text{Angle } 1))$$

$$Ytrack47=\mathrm{SIN}(\text{Angle } 3)\times(A1/\mathrm{COS}(\text{Angle } 1))$$

The X and Y axes are as indicated in FIG. 10 for each point constructed.

The track 49 in one ring extends in the radial direction to take up the radial displacement of the corresponding end of the pin 46 arising from the geometry of the track 47 in the other ring.

As it is the intersection point or triangle apex B1/C1 that alters its position relative to the center of the rings, the shape of the track 47 is given by:

$$Xtrack49=A1/\mathrm{COS}(\text{Angle } 1)$$

$$Ytrack49=0$$

such that the fixed distance is maintained between the ends of the pins 46 in corresponding points of tracks 47 and 49.

Those skilled in the art will readily appreciate that it is possible to achieve displacement of beam shaping blades radially and circumferentially by means of rotating rings in many other ways.

Figure 11:
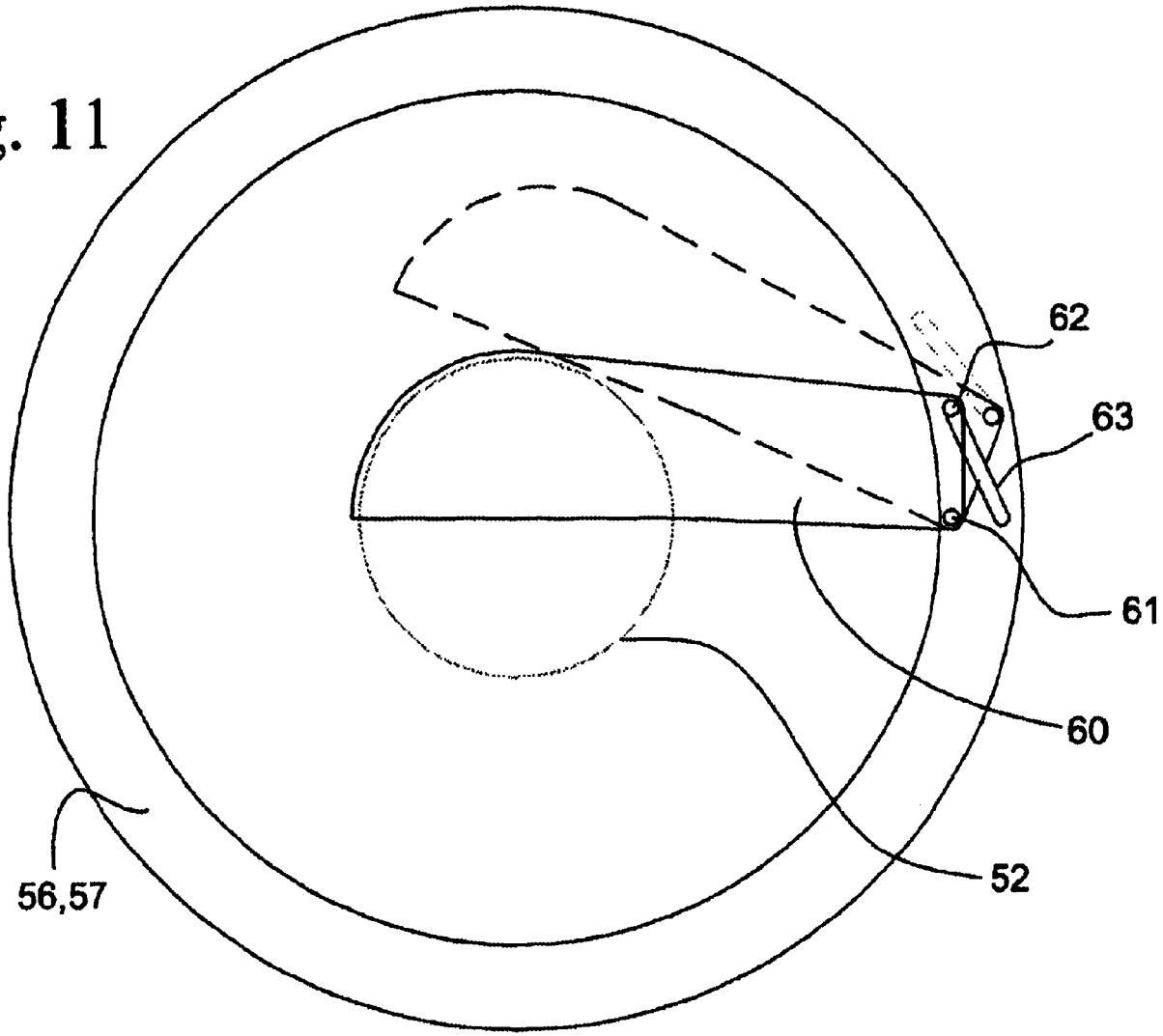
FIG. 11 schematically illustrates an alternative embodiment of the beam-shaping blades and the adjustment mechanisms therefor.
Figure 12:
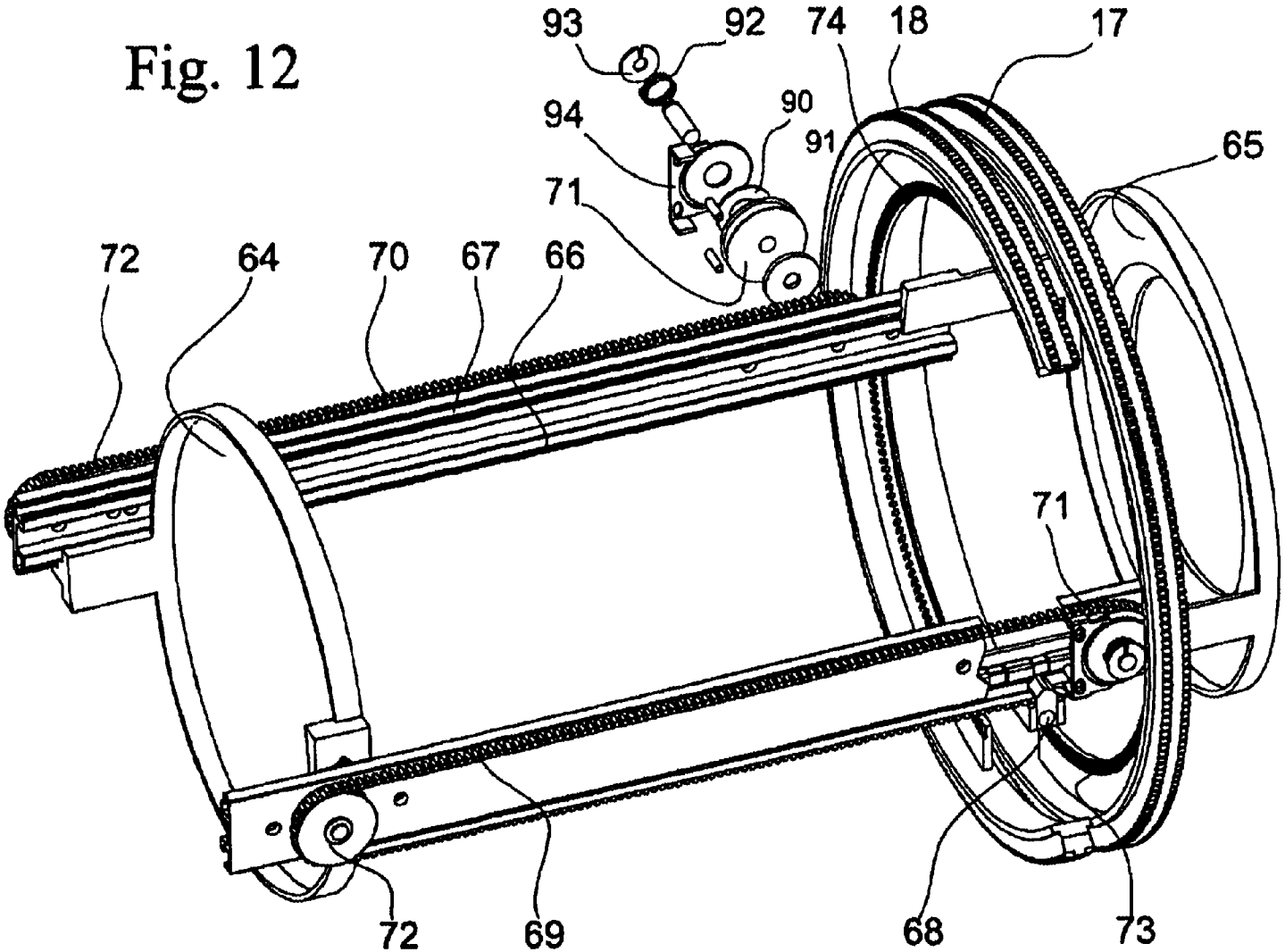
FIG. 12 shows an isometric partly exploded view in larger scale of the position adjustment mechanism for the lenses shown in FIG. 2.
Figure 13:
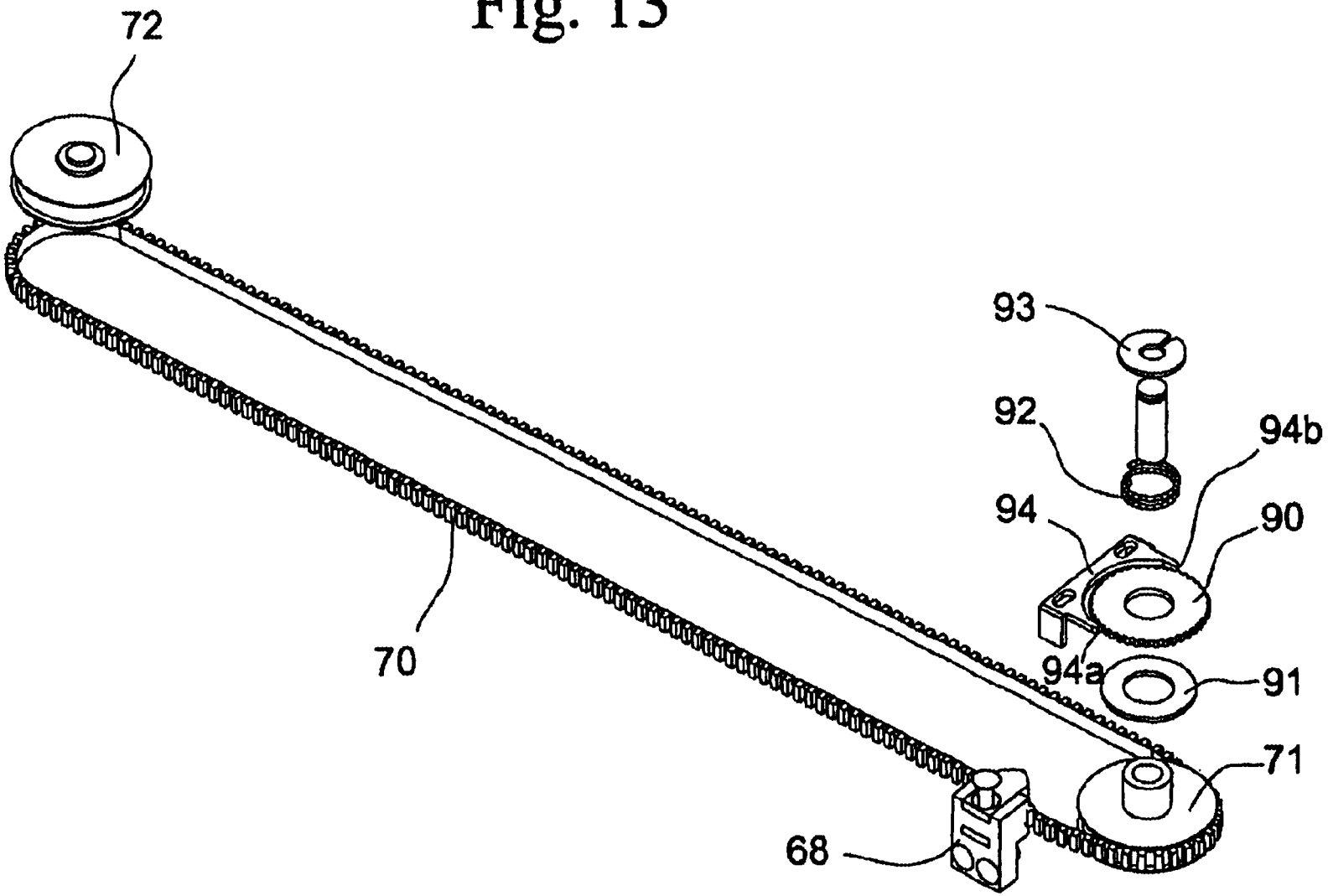
FIG. 13 shows an enlarged view of a detail of the construction shown in FIG. 12.

Referring now to FIG. 11, an alternative way of arranging the beam shaping blades is shown schematically. Two adjustment rings 56, 57 similar to the adjustment rings 9,10 of FIGS. 8 and 9 are arranged abutting each other with a beam shaping blade 60 arranged therebetween and attached to the rings by means of two guiding pins 61 and 62. The pin 61 is received in a recess in the lateral surface of the ring 57 facing the ring 56, the recess having a shape that only allows rotation of the pin 61 therein. The pin 62 is received in a linear track 63 recessed into the lateral surface of the ring 56 facing the ring 57. The pin 62 may slide in the track 63.

The situation wherein the blade 60 maximally obstructs the beam of light 52 is shown in full lines while the situation wherein the blade 60 does not obstruct the beam 52 is shown in dotted lines. The fully obstructing position of the blade 60 is amended to the non-obstructing position thereof by rotating the rings 56 and 57 relative to one another, for instance as shown by rotating the ring 56 counterclockwise and maintaining the ring 57 in the same position. Hereby the pin 62 will be forced to slide in the track 63 while the pin 61 merely rotates such that the blade rotates around the pin 61. In the shown example a rotation of the ring 56 counterclockwise 12 degrees will result in a rotation of 22 degrees of the blade 60.

This arrangement of the beam shaping blades requires relatively stiff blades and/or relatively large axial spacing between the individual blades so that the blades will not interfere with or engage one another when being rotated.

Referring now to FIGS. 2, 3, 12 and 13, the mechanism for displacing the focusing lens 22 and the zoom lens 23 along the longitudinal axis 19 is shown in partly exploded form. A holder 64 for the zoom lens 23 and a holder 65 for the focusing lens 22 are slidingly arranged in tracks 66 and 67, respectively, in track rails so that the holders 64 and 65 may be displaced to and fro parallel to the longitudinal axis 19.

A bracket 68 is connected to each of the holders 64 and 65, only the bracket 68 for the holder 65 being visible. The brackets are each connected to a respective toothed belt 69 and 70 corresponding to the holders 65 and 64, respectively. The toothed belts are mounted on pulleys 71 and 72 rotatably mounted on the track rails 66, 67.

Each of the adjustment rings 17 and 18 (partly cut away for clarity in FIG. 12) are provided with lateral toothed portions 73 and 74, respectively, for engaging the teeth of the toothed belts 69 and 70, respectively, so that rotation of the ring 17 to and fro will cause displacement of the toothed belt 69 to and fro, and rotation to and fro of the ring 18 will cause displacement to and fro of the toothed belt 70. Hereby, the lens holders 64 and 65 may be displaced to and fro along the tracks 66 and 67 by rotation to and fro of the rings 18 and 17, respectively.

Hereby, a simple, precise and relatively silent displacement mechanism is achieved for adjusting the position of the lenses along the longitudinal axis.

When the lighting fixture 1 is oriented with the axis 19 thereof steeply inclined, i.e. pointing upwards or downwards steeply, the weight of the lenses, particularly the zoom lens 23, will tend to force the lens up or down from the desired and adjusted position, especially if vibration of the fixture takes place. This tendency can be curtailed or eliminated by introducing an inertia or braking in the displacement mechanism.

However, if the inertia is present constantly, for instance a constant brake force applied to the toothed belts, then displacement of the lens will require additional tangential force applied to the rims of the rings 17 and 18. Naturally, this is undesirable both for manual operation, requiring greater exertion of force by the operator's fingers, and for motorized operation, requiring a more powerful motor with attendant increases in costs and possibly noise.

The displacement mechanism according to the invention is provided with a braking function that only is effective when displacement of the lens is not taking place, i.e. the braking function is only in force when the rings 17 or 18 are not being rotated. The principles of the selective braking mechanism according to the invention and described in the following are of course also applicable in other applications where a displacement of an object with subsequent braking of the object in the displaced position is desirable.

The selective braking mechanism (FIGS. 12-13) according to the invention comprises the pulley 71, a locking wheel 90, a friction washer 91, a friction spring 92, a locking washer 93 and a locking sled 94. The spring 92 presses the locking wheel 90 and the friction washer 91 against the pulley 71 so as to create a suitable friction between the locking wheel 90 and the pulley 71. The locking sled 94 is arranged between the two parallel lengths of the toothed belt and for displacement to and fro in the plane of said toothed belt 70, perpendicularly to said two parallel lengths. The locking sled is provided with locking teeth 94*a* and 94*b* for locking engagement with teeth at the rim of locking wheel 90 in a ratchet type action. If the locking sled 94 is in a central position, i.e. not displaced toward any of the two parallel lengths of the belt 70, then the locking teeth 94*a* and 94*b* will not engage the teeth of the locking wheel 90 so no friction brake is applied to the belt 70.

The dimension of the locking sled 94 perpendicular to the parallel lengths of the belt 70 is slightly longer than the distance between the common tangents of the pulleys 71 and 72 such that in the central position of the locking sled 94, the locking sled will press against the parallel lengths of the belt 70.

If tension is applied to one of the parallel lengths of the toothed belt 70 because of the weight of the lens, said length will be tightened and the parallel length will be loosened whereby the locking sled 94 will be displaced from the central position to a lateral position where the respective one of the locking teeth 94*a* and 94*b* will engage the ratchet teeth of the locking wheel 90, thereby applying frictional braking forces to the pulley 71 through the friction washer 91.

However, if tension in one of the parallel lengths of the belt 70 is caused by rotation of the ring 18 for axial displacement of the holder 64, then the displacement of the locking sled 94 from the central position thereof will not cause engagement of one of the locking teeth 94*a* or 94*b* with the ratchet teeth of the locking wheel 90 as the ratchet effect will cause the respective locking tooth to "ratchet" over the ratchet teeth.

Hereby, a selective braking mechanism is achieved whereby the brake effect is operative, when the weight of the lens tries to rotate the respective adjustment rings, but the brake effect is inoperative when rotation of the respective ring is carried out to displace the lens axially.

It will be apparent to those skilled in the art that the principles of the above selective braking mechanism may be applied in all applications where a braking effect is required in one direction of force application and is not required in the opposite direction of force application.

The arrangement of the gobo or pattern 29 in the ring 8 and the iris 28 in the ring 7 need not be described herein as it will be apparent to those skilled in the art that this can be done in many ways well known in the art.

For remote control of the adjustment rings it will also be readily apparent to those skilled in the art that an electrical motor 100 with a pinion 101 for each ring may be arranged such that the teeth of the pinion 101 mesh with the teeth on the rim of the respective ring. The motors 100 for instance may be firmly attached to the frame 6 or be spring biased so that any irregularities in the mountings of the rings and thereby the toothed rims may be taken up. Magnetic markers 102 may be attached to the rings such that a sensing means 103 may sense the marker 102 and thereby precisely identify the position of the respective ring as a basis for the subsequent rotation thereof to a new setting of the respective beam influencing means.

What is claimed is:

1. A lighting fixture for projecting a beam of light and for use for spot lighting in connection with theater stages, cinema and television studios and the like, the fixture comprising:

a light source arranged at one end of a housing having a light beam exit aperture at the opposite end thereof, the light source and aperture being arranged generally concentric with a longitudinal or optical axis of the housing;

light beam influencing means comprising at least one beam-shaping blade that is adjustable to shape the periphery of a light beam emitted by the light source so as to form the light beam into a selected one of a plurality of geometric shapes, and a light influencing element selected from the group consisting of a lens, an iris, and a pattern or gobo, for influencing the light beam emitted by the light source and being arranged along the path of the light beam along said longitudinal axis through the housing from the light source to the aperture; and adjustment means operatively associated with each beam-shaping blade for adjusting the position of its associated beam-shaping blade relative to said longitudinal axis, each adjustment means comprising an annular body arranged with the axis thereof substantially coinciding with the longitudinal axis, and being arranged for rotation around said longitudinal axis and being connected to its associated beam-shaping blade such that rotation of the adjustment means around said longitudinal axis adjusts the position of the associated beam-shaping blade relative to said longitudinal axis.

2. A lighting fixture according to claim 1, wherein the annular body comprises an outer rim configured for being engaged for applying a rotational force thereto, the surface of said outer rim being provided with friction enhancing means.

3. A lighting fixture according to claim 2, further comprising an electrical motor connected to a drive wheel engaging said outer rim of the annular body for applying the rotational force thereto.

4. A lighting fixture according to claim 3, wherein the drive wheel is a gear having teeth, and wherein the outer rim engaged by the gear is provided with teeth for meshing with the teeth of said gear when said gear rotates.

5. A lighting fixture according to claim 1, wherein the annular body is provided with a position indicating means for indicating the angular position of the annular body relative to said longitudinal axis.

6. A lighting fixture according to claim 5, wherein the position indicating means comprises an element that may be remotely sensed, and wherein the fixture further comprises remote sensing means for sensing the angular position of said element relative to said longitudinal axis.

7. A lighting fixture for projecting a beam of light and for use for spot lighting in connection with theater stages, cinema and television studios and the like, the fixture comprising:

a light source arranged at one end of a housing having a light beam exit aperture at the opposite end thereof, the light source and aperture being arranged generally concentric with a longitudinal or optical axis of the housing;

light beam influencing means comprising at least one beam-shaping blade that is adjustable to shape the periphery of alight beam emitted by the light source so as to form the light beam into a selected one of a plurality of geometric shapes, and a light influencing element selected from the group consisting of a lens, an iris, and a pattern or gobo, for influencing the light beam emitted by the source and being arranged along the path of the light beam along said longitudinal axis through the housing from the light source to the aperture; and adjustment means operatively associated with each beam-shaping blade for adjusting the position of its associated beam-shaping blade relative to said longitudinal axis, each adjustment means being arranged for rotation around said longitudinal axis and being connected to its associated beam-shaping blade such that rotation of the adjustment means around said longitudinal axis adjusts the position of the associated beam-shaping blade relative to said longitudinal axis;

wherein the adjustment means comprises radial adjustment means for adjusting the position of the blade radially relative to said axis, and circumferential adjustment means for adjusting the position of said blade circumferentially around said axis, and wherein the radial adjustment means comprises two adjacent co-centrical rings each connected to one point of the blade such that relative rotation of the two rings alters the radial position of the blade.

8. A lighting fixture according to claim 7, wherein the blade comprises a body extending generally transversely to said axis and two arms extending generally parallel to said axis, the arms each being provided with sliding connecting means for connecting the respective arm to each of the rings by being slidingly received in a guiding track in each of said rings.

* * * * *